US005435417A

United States Patent [19]

Hakala

[11] Patent Number: 5,435,417

[45] Date of Patent: Jul. 25, 1995

[54] ELEVATOR MOTOR PLACED IN THE COUNTERWEIGHT

[75] Inventor: Harri Hakala, Hyvinkää , Finland

[73] Assignee: Kone Oy, Helsinki, Finland

[21] Appl. No.: 178,136

[22] Filed: Jan. 6, 1994

[30] Foreign Application Priority Data

Jan. 11, 1993 [FI] Finland ..... 930101

[51] Int. Cl.[6] ..... B66B 17/12

[52] U.S. Cl. ..... 187/404; 187/266

[58] Field of Search ..... 187/94, 20, 17, 1 R, 187/112, 404, 266

[56] References Cited

U.S. PATENT DOCUMENTS

| | | | |
|---|---|---|---|
| 3,101,130 | 8/1963 | Bianca | 187/94 |
| 3,101,130 | 8/1963 | Bianca | 187/20 |
| 3,878,916 | 4/1975 | White, Jr. | 182/145 |
| 4,679,661 | 7/1987 | Gibson | 187/20 |
| 4,771,197 | 9/1988 | Ivanto et al. | 310/67 R |
| 4,960,186 | 10/1990 | Honda | 187/20 |
| 5,018,603 | 5/1991 | Ito | 187/17 |
| 5,018,603 | 5/1991 | Ito | 187/17 |
| 5,025,893 | 6/1991 | Saito | 187/20 |
| 5,062,501 | 11/1991 | Pavoz et al. | 187/112 |
| 5,300,737 | 4/1994 | Nakanishi | 187/94 |

FOREIGN PATENT DOCUMENTS

| | | |
|---|---|---|
| 2609974 | 7/1988 | France . |
| 4640604 | 6/1990 | France . |
| 3834790 | 4/1989 | Germany . |
| 2201657 | 9/1988 | United Kingdom . |

*Primary Examiner*—Kenneth Noland

[57] ABSTRACT

In this invention, an elevator motor (6) provided with an external rotor (17) and a traction sheave (18) is so implemented that it simultaneously constitutes the counterweight (26) of a rope-suspended elevator (1). In this motor/counterweight structure, rotating induction motors can be used. A gear is not necessary because the construction of the invention and the placement of the motor allow the use of a motor with a large diameter and therefore a high torque. As the length of the motor still remains small, the motor/counterweight of the invention can be accommodated in the space normally reserved for a counterweight in an elevator shaft.

12 Claims, 1 Drawing Sheet

ELEVATOR MOTOR PLACED IN THE COUNTERWEIGHT

BACKGROUND OF THE INVENTION

The conventional elevator machinery comprises a hoisting motor driving a set of traction sheaves via a gear, the elevator hoisting ropes being passed around the traction sheaves. The hoisting motor, the elevator gear and the set of traction sheaves are commonly placed in a machine room above the elevator shaft. They can also be placed beside or below the elevator shaft. Previously known are also solutions in which the elevator machinery is placed in the counterweight. The use of a linear motor as a hoisting motor for an elevator and its placement in the counterweight are also previously known.

Conventional elevator motors, e.g. cage induction motors, slip-ring motors or d.c. motors, have the advatage that they are simple and their characteristics and the relevant technology have been developed to a reliable level in the course of decades. Moreover, they are advantageous with respect to price. Placement of a conventional elevator machinery in the counterweight is proposed e.g. in U.S. Pat. No. 3,101,130. A drawback with the placement of the elevator motor suggested in this publication is that the counterweight requires a large cross-sectional area in the shaft.

The use of a linear motor as the hoisting motor of an elevator involves problems because the primary or the secondary structure of the motor needs to be as long as the shaft. Therefore, linear motors are expensive to use with elevators. A linear motor application for an elevator, with the motor placed in the counterweight, is presented e.g. in the U.S. Pat. No. 5,062,501. Still, a linear motor placed in the counterweight has certain advantages, e.g. that no machine room is needed and that the cross-sectional counterweight area required by the motor is relatively small.

Another previously known solution is to use a so-called external-rotor motor, in which the rotor is directly attached to the elevator traction sheave. This type of motor construction is proposed e.g. in U.S. Pat. No. 4,771,197. The motor has a fixed shaft and uses separate shaft supports. The motor is gearless. A problem with this construction is that, to produce a sufficient torque, the length and diameter of the motor must be increased, and this is in most cases impossible beceause there is not enough space in the elevator machine room. In the construction presented in U.S. Pat. No. 4,771,197, the length of the motor is further increased by the brake, which is placed by the side of the rope grooves, and it is also increased by the shaft supports.

SUMMARY OF THE INVENTION

The object of the present invention is to produce a new structural solution for the placement of an external-rotor type motor as an elevator motor which will eliminate the above drawbacks of previously known elevator motors.

The invention is characterized by the features presented in the characterization part of claim 1.

The advantages of the invention include the following:

The placement of the elevator motor as provided by the invention obviates the need to build an elevator machine room or a stator or rotor as long as the elevator shaft.

The present invention also provides a solution for the space requirement resulting from the increased motor diameter in the construction presented in U.S. Pat. No. 4,771,197. Likewise, the length of the motor, i.e. the thickness of the counterweight, is substantially smaller in the motor/counterweight of the present invention than in the motor according to U.S. Pat. No. 4,771,197.

An amount of counterweight material corresponding to the weight of the motor is saved.

A motor construction allowing a low speed of rotation and a large diameter is now possible, which means that the motor is less noisy and does not necessarily need a gear because it has a high torque.

The motor/counterweight of the invention has a very small thickness, so its cross-sectional area in the cross-section of the elevator shaft is also small and the motor/counterweight can be easily accommodated in the space normally reserved for a counterweight.

A normal motor construction can be used, i.e. the motor can be a cage induction, slip-ring or d.c. motor, for which the technology is well known.

BRIEF DESCRIPTION OF THE DRAWINGS

In the following, the invention is described in detail by the aid of one of its embodiments by referring to the drawings, in which.

DETAILED DESCRIPTION OF THE INVENTION

Figure 1:
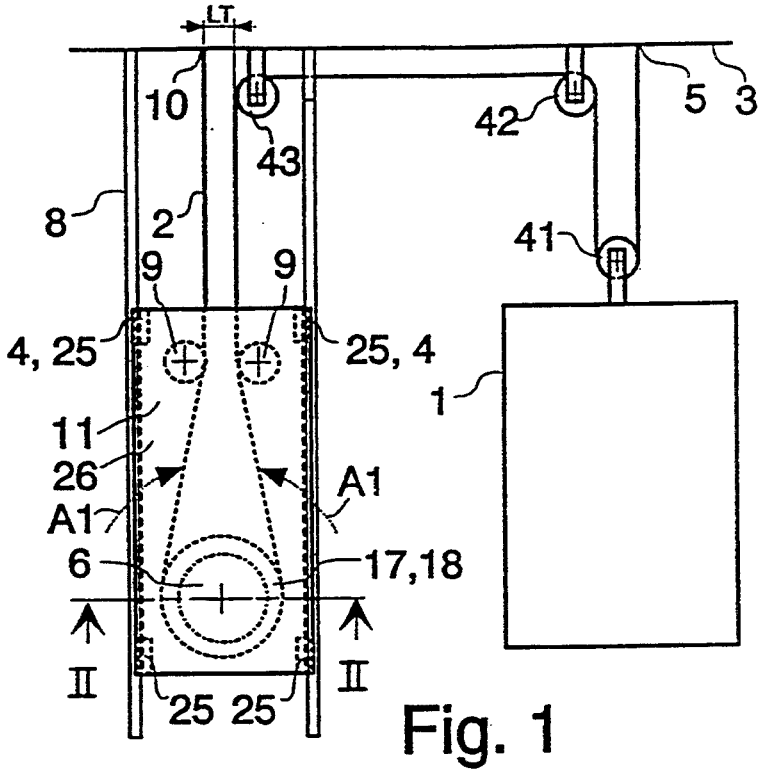
FIG. 1 presents a diagram of an elevator motor according to the invention, placed in the counterweight and linked with the elevator by means of ropes.

FIG. 1 shows a diagrammatic view of an elevator shaft. The elevator car 1, suspended with ropes 2, moves in the shaft in a substantially vertical direction. One end of each rope 2 is attached to point 5 at the top 3 of the shaft, from where the ropes 2 run around a diverting pulley 41 on the elevator car 1 to diverting pulleys 42 and 43 at the top 3 of the shaft and further around the traction sheave 18 of the elevator motor 6 placed in the counterweight 26 and back to the top 3 of the shaft, where the other end of the ropes 2 is attached at point 10. The counterweight 26 and the elevator motor 6 are integrated together. The motor/counterweight moves vertically between guide rails 8, which receive the forces generated by the motor torque. The counterweight is provided with gripping elements 4, which, when activated by overspeed of the counterweight or under separate control, stop the motion of the counterweight relative to the guide rails 8. The space LT required by the ropes in the horizontal direction of the elevator shaft is determined by the diverting pulleys 9 in the counterweight, the fixing point 10 of the ropes and the position of diverting pulley 43 at the top 3 of the shaft. The position of diverting pulleys 9 relative to the traction sheave 18 determines the magnitude of the angle of contact of the ropes around the traction sheave. Diverting pulleys 9 also increase the frictional force between the rope 2 and the traction sheave 18 by increasing the angle of contact A1 of the rope around the traction sheave, which is another advantage of the invention. FIG. 1 does not show the supply of power to the electric equipment nor the guide rails of the elevator car, because these are outside the sphere of the invention.

The motor/counterweight of the invention can have a very flat structure. The width of the counterweight can be normal, i.e. somewhat narrower than the width of the elevator car. For an elevator with a load capacity of 800 kg, the diameter of the rotor of the motor of the invention is about 800 mm and in this case the thickness of the whole counterweight is only about 160 mm. Thus, the counterweight of the invention can easily be accommodated in the space normally reserved for the counterweight. An advantage provided by the large diameter of the motor is that a gear is not necessarily needed.

Figure 2:
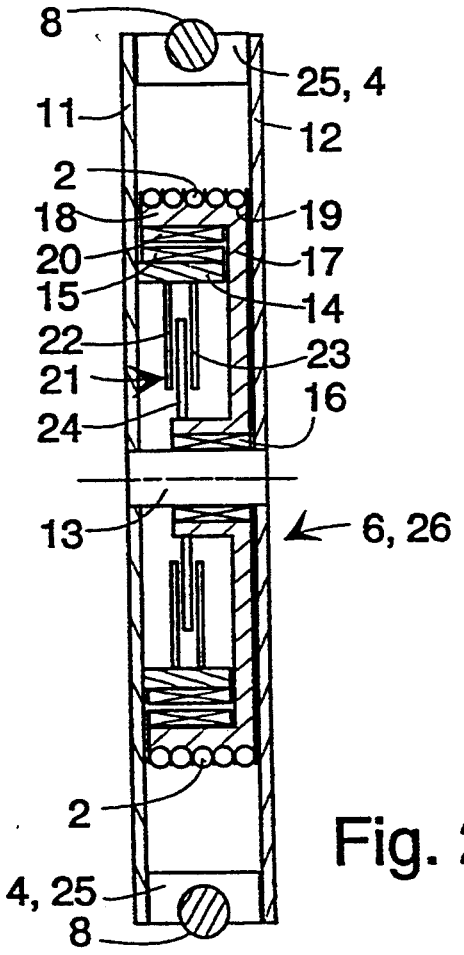
FIG. 2 presents a cross-section of the elevator motor placed in the counterweight.

FIG. 2 presents a section II—II through the elevator motor 6 in FIG. 1. A motor structure suitable for an elevator counterweight 26 is achieved by making the motor from parts usually called end shields, a stator supporting element 11 which also forms a side plate of the counterweight. Thus, the side plate 11 constitutes a frame part which transmits the load of the motor and counterweight. The structure comprises two side plates or supporting elements, 11 and 12, the motor axle 13 being placed between these. Attached to side plate 11 is also the stator 14 of the motor, with a stator winding 15. Alternatively, side plate 11 and the stator 14 may be integrated as a single structure. The rotor 17 is rotatably mounted on the axle 13 by means of a bearing 16. The traction sheave 18 on the exterior surface of the rotor is provided with five rope grooves 19. The five ropes 2 pass about once around the traction sheave. The traction sheave 18 may be a separate cylindrical body around the rotor, or the traction sheave rope grooves may be made directly on the outer surface of the rotor, as shown in FIG. 2. The rotor winding 20 is placed on the interior surface of the rotor. Between the stator 14 and the rotor 17 is a brake 21 consisting of brake discs 22 and 23 attached to the stator and a brake disc 24 rotating with the rotor. The axle 13 is fixed with the stator, but alternatively it could be fixed with the rotor, in which case the bearing would be between side plate 11 or both side plates 11,12 and the rotor 17. Attached to the side plates of the counterweight are sliding guides 25, which guide the counterweight as it moves between the guide rails 8. The sliding guides also transmit the supporting forces resulting from the operation of the motor to the guide rails. Side plate 12 acts as an additional reinforcement and a stiffener for the motor/counterweight structure, because the horizontal axle 13, sliding guides 25 and the diverting pulleys 9 guiding the ropes are attached to opposite points in the two side plates 11 and 12. Alternatively, the axle 13 could be attached to the side plates by means of auxiliary flanges, but this is not necessary for the description of the invention.

It is obvious to a person skilled in the art that different embodiments of the invention are not restricted to the example described above, but that they may instead be varied within the scope of the claims presented below. It is thus obvious to the skilled person that it is unessential to the invention whether the counterweight is considered as being integrated with the elevator motor or the elevator motor with the counterweight, because in both cases the outcome is the same, only the designations used might be changed. For the invention, it makes no difference if e.g. the side plates of the counterweight are called parts of the motor or parts of the counterweight.

I claim:

1. An integrated elevator counterweight assembly for a rope-suspended elevator (1), comprising a motor (6) and a counterweight (26), said counterweight being movable along guide rails (8), characterized in that the elevator motor (6) is an external-rotor type elevator motor comprising a stator (14,15), a first side plate (11) for the stator (14,15), and a rotor (17) provided with a traction sheave (18), an axle (13) and a bearing (16).

2. The assembly according to claim 1, characterized in that the elevator motor (6) and the counterweight (26) of the elevator have at least one structural part in common.

3. The assembly according to claim 2, characterized in that the at least one structural part includes said first side plate (11) acting as the frame of the counterweight (26).

4. The assembly according to claim 3, characterized in that the stator (14,15) is fixedly attached to said first side plate (11) acting as the frame of the counterweight (26), and that the rotating rotor (17) provided with the traction sheave (18) is also mounted on said first side plate (11) by means of the axle (13) and the bearing (16).

5. The assembly according to claim 4, characterized in that the axle (13) is affixed to said first side plate (11) and the bearing (16) is between the axle (13) and the rotor (17).

6. The assembly according to claim 4, characterized in that the axle (13) is affixed to the rotor (17) and the bearing (16) is between the axle (13) and said first side plate (11).

7. The assembly according to claim 3, characterized in that it has at least one sliding guide (25) for the guide rails (8), said guide (25) being attached to said first side plate (11) acting as the frame of the counterweight.

8. The assembly according to claim 3, characterized in that it has at least one gripping element (4) attached to said first side plate (11) acting as the frame of the counterweight, said at least one gripping element (4) serving to stop the motion of the counterweight relative to the guide rails (8).

9. The assembly according to claim 3, characterized in that, in addition to said first side plate (11) acting as the frame of the counterweight (26), the counterweight is provided with a second side plate (12), the axle (13) being mounted between said first and second side plates (11,12) or supported therebetween by means of a bearing, on which said first and second side plates (11,12) a diverting pulley (9) and/or at least one sliding guide (25) is mounted and/or to which said first and second side plates (11,12) at least one gripping element (4) is attached.

10. An elevator motor (6) placed in a counterweight (26) of a rope-suspended elevator (1), said counterweight being movable along guide rails (8), characterized in that the elevator motor (6) is an external-rotor type elevator motor comprising:

a stator (14, 15);

a first side plate for the stator (14, 15); said first side plate being a structural element common to the elevator motor (6) and the counterweight (26) and acting as the frame of the counterweight (26); and a rotor (17) provided with a traction sheave (18), an axle (13) and a bearing (16); and said counterweight being provided with a second side plate (12), wherein the axle (13) is mounted between said first and second side plates (11,12) or supported therebetween by means of the bearing, on which said first and second side plates (11,12) a diverting pulley (9) and/or at least one sliding guide (25) is mounted and/or to which said first and second side plates (11,12) at least one gripping element (4) is attached.

11. An elevator motor (6) placed in a counterweight (26) of a rope-suspended elevator (1), said counterweight being movable along guide rails (8), characterized in that the elevator motor (6) is an external-rotor type elevator motor comprising:

a stator (14, 15);

a first side plate (11) fixedly attached to the stator (14, 15), said first side plate being a structural element common to the elevator motor (6) and the counterweight (26) and acting as the frame of the counterweight (26);

a rotating rotor (17) provided with a traction sheave (18), an axle (13) and a bearing (16), the rotating rotor (17) with the traction sheave (18) being mounted on said first side plate (11) by means of the axle (13) and the bearing (16), the axle (13) being fixed to the side plate (11) and the bearing (16) being disposed between the axle (13) and the rotating rotor (17), and a brake (21), said brake being placed between said first side plate (11) or the stator (14, 15) and the rotor (17) or the axle (13).

12. An elevator motor (6) placed in the counterweight (26) of a rope-suspended elevator (1), said counterweight being movable along guide rails (8), characterized in that the elevator motor (6) is an external-rotor type elevator motor comprising:

a stator (14, 15);

a first side plate (11) for the stator (14, 15), said first side plate being a structural element common to the elevator motor (6) and the counterweight (26) and acting as the frame of the counterweight (26);

a rotating rotor (17) provided with a traction sheave (18) for supporting suspension rope, an axle (13) and a bearing (16); and at least one diverting pulley (9) mounted on the first side plate (11), said at least one diverting pulley being used to change the angle (A1) of contact of the rope (2) running around the traction sheave (18).

* * * * *